United States Patent [19]

Okada

[11] Patent Number: 5,018,737

[45] Date of Patent: May 28, 1991

[54] SLOT MACHINE

[75] Inventor: Kazuo Okada, Tokyo, Japan

[73] Assignee: Kabushiki Kaisha Universal, Tochigi, Japan

[21] Appl. No.: 570,874

[22] Filed: Aug. 22, 1990

[30] Foreign Application Priority Data

Aug. 23, 1989 [JP] Japan ..... 1-216585

[51] Int. Cl.[5] ..... A63F 5/04

[52] U.S. Cl. ..... 273/143 R

[58] Field of Search ..... 273/143 R, 143 C, 143 D, 273/143 E, 138 A

[56] References Cited

U.S. PATENT DOCUMENTS 4,373,727 2/1983 Hooker et al. ..... 273/143 R 4,858,932 8/1989 Keane ..... 273/143 R

*Primary Examiner*—Benjamin Layno

*Attorney, Agent, or Firm*—Young & Thompson

[57] ABSTRACT

A slot machine having a drive controller for changing the time required for series of symbols to decelerate and stop. For a game that can result in a hit, the series of symbols are controlled to stop by the required stop time set, e.g. longer than that for a game that cannot result in a hit. From the difference between required stop times, a player can know whether the game can be a hit even while the game is still in progress. The monotony of waiting until the series of symbols has fully stopped is thus to some extent relieved.

5 Claims, 4 Drawing Sheets

SLOT MACHINE

BACKGROUND OF THE INVENTION

The present invention relates to a slot machine capable of visually suggesting that a game now being played will result in a hit.

A slot machine has a plurality, e.g. three to five, of reels with a plurality of symbols in a series on each outer periphery thereof. These reels start rotating when a game starts. After the rotation of each reel reaches a constant speed, a stop control can be executed. This stop control for each reel rotating at a constant speed is effected upon actuation of a stop button in the case of a slot machine of the manual stop type, or by the operation of an automatic stop device in the case of a slot machine of the automatic stop type. When all the reels have stopped, the presence or absence of a hit is determined according to the combination of symbols on the respective reels stopping on at least one winning line. The number of winning lines is determined by the number of inserted coins. Coins corresponding in number to the rank of the hit are paid out.

As used herein, the term "coins" includes tokens.

In a conventional slot machine, at a certain time during the period between inserting the coins and starting the reel stop control, a judgment is made by using random numbers whether or not the game is to have a hit; and if a hit is to occur, its rank also is determined. In accordance with this judgment, the reel stop control is effected. In a slot machine of the manual stop type, even a game which otherwise would be a hit may result in a lost game because the reel stop positions are restricted. In this case, the hit is carried over to the next game.

Players naturally want a big hit with many coins paid out or a bonus game having a high hit probability. But such special hits cause many coins to be paid out. In order to maintain a stable payout rate, the probability of occurrence of special hits is controlled by using random numbers as described before, to inhibit concentrated occurrences of special hits. With a limited or low probability of occurrence of special hits, players tend to have the impression that a special hit may suddenly occur after a number of repeated games. Most of the games therefore arouse the player's interest only after the reels stop, with an uninteresting wait during the period from the start of rotation of the reels to their stopping. This is one of the major reasons that known games are monotonous and dull. The same problem is also associated with a slot machine of the type wherein symbols are displayed on a CRT instead of reels.

OBJECT OF THE INVENTION

It is therefore an object of the present invention to provide a slot machine capable of notifying a player, before the series of symbols stop, that the game now being played may result in a hit.

SUMMARY OF THE INVENTION

In order to achieve the above and other objects and advantages of this invention, whether or not a game can result in a hit is first judged. The time required for the series of symbols to stop is changed, depending on whether the game may or may not be a hit. The player can thereby recognize from the required reel stop time whether or not the game can be a hit.

According to a preferred embodiment of this invention, the required reel stop time is set longer for a game that can be a hit than that for a game that cannot. On the contrary, the required reel stop time for a game that can be a hit may be made shorter than for the other.

According to the present invention, whether a game can be a hit can be foretold while the series of symbols are still in motion. The monotony of the game can thus be relieved. Such a stop control is preferably effected in a game that can result in a special hit with a large award. However, it is not limited thereto; and such prior indication may be given in a game that can result in even a small hit.

BRIEF DESCRIPTION OF THE DRAWINGS

The above and other objects and advantages of the present invention will become apparent from the following detailed description of the invention when read in connection with the accompanying drawings, in which.

DETAILED DESCRIPTION OF THE INVENTION

Figure 1:
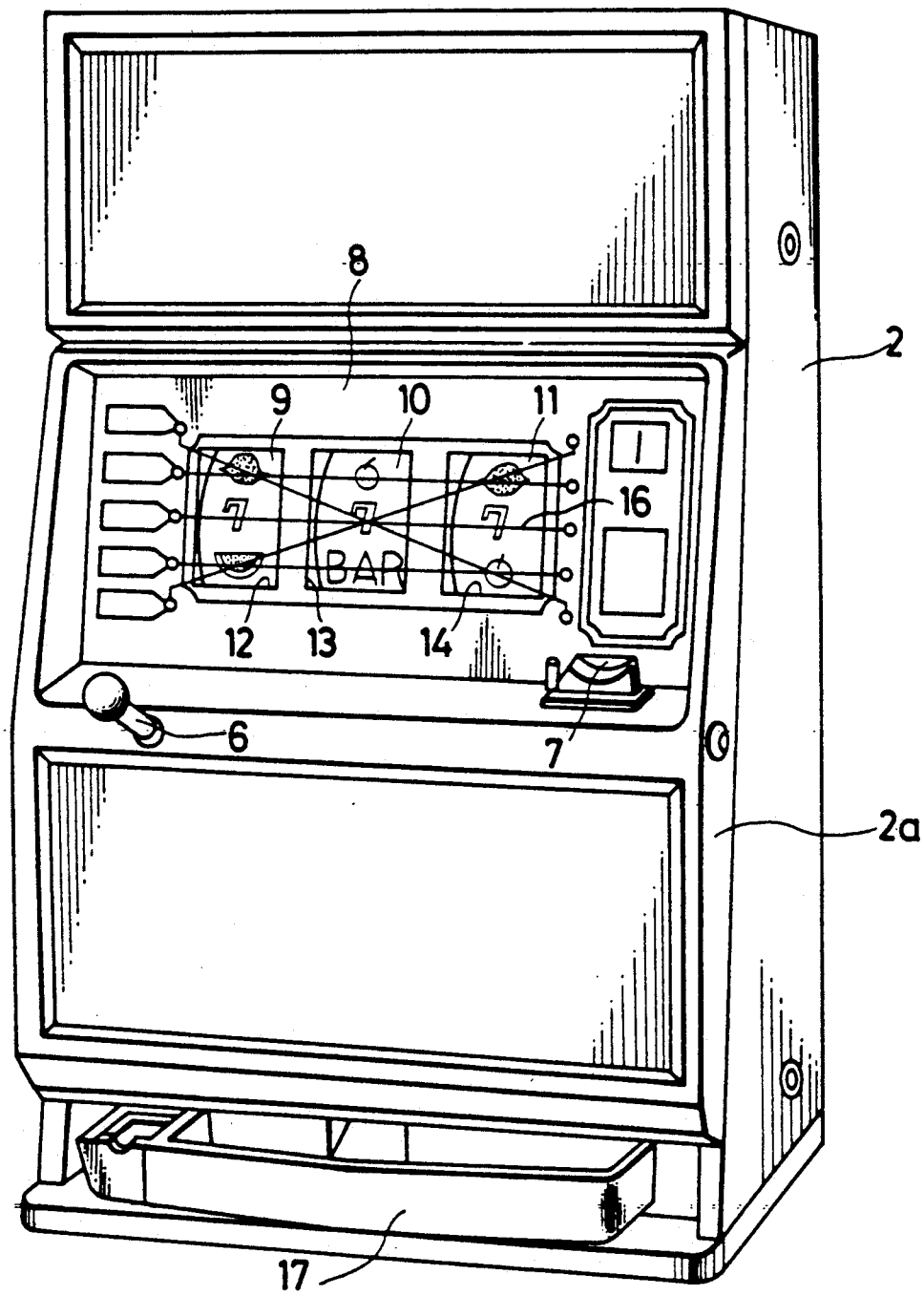
FIG. 1 is a front perspective view showing an embodiment of the slot machine according to the present invention.

Referring now to FIG. 1, a slot machine 2 has a front door 2*a* capable of being opened and closed. The front door 2*a* has a start lever 6 and coin inlet 7 mounted thereon. A front panel 8 is fitted in the front door 2*a*. First to third reels 9 to 11 are rotatably mounted at the back of the front panel 8. On the outer periphery of each reel 9 to 11, various symbols such as "lemon", "7", and "bell" are drawn and can be viewed from three windows 12 to 14 formed in the front panel 8. A plurality of winning lines 16 are drawn over the windows 12 to 14, the arrangement being such that the larger is the number of inserted coins, the larger will be the number of effective winning lines.

Upon actuation of the start lever 6 after coins are inserted into the coin inlet 7, the reels 9 to 11 start rotating simultaneously and reach a constant angular velocity. After the lapse of a predetermined period of time, the stop control for each of the reels 9 to 11 operates, thereby to stop the first reel 9, second reel 10 and third reel 11 in this order. A symbol combination is composed of three symbols on the stopped reels aligned on an effective winning line 16. If the symbol combination is a hit symbol combination, coins corresponding in number to the rank of the hit are paid out into a coin saucer 17.

Figure 2:
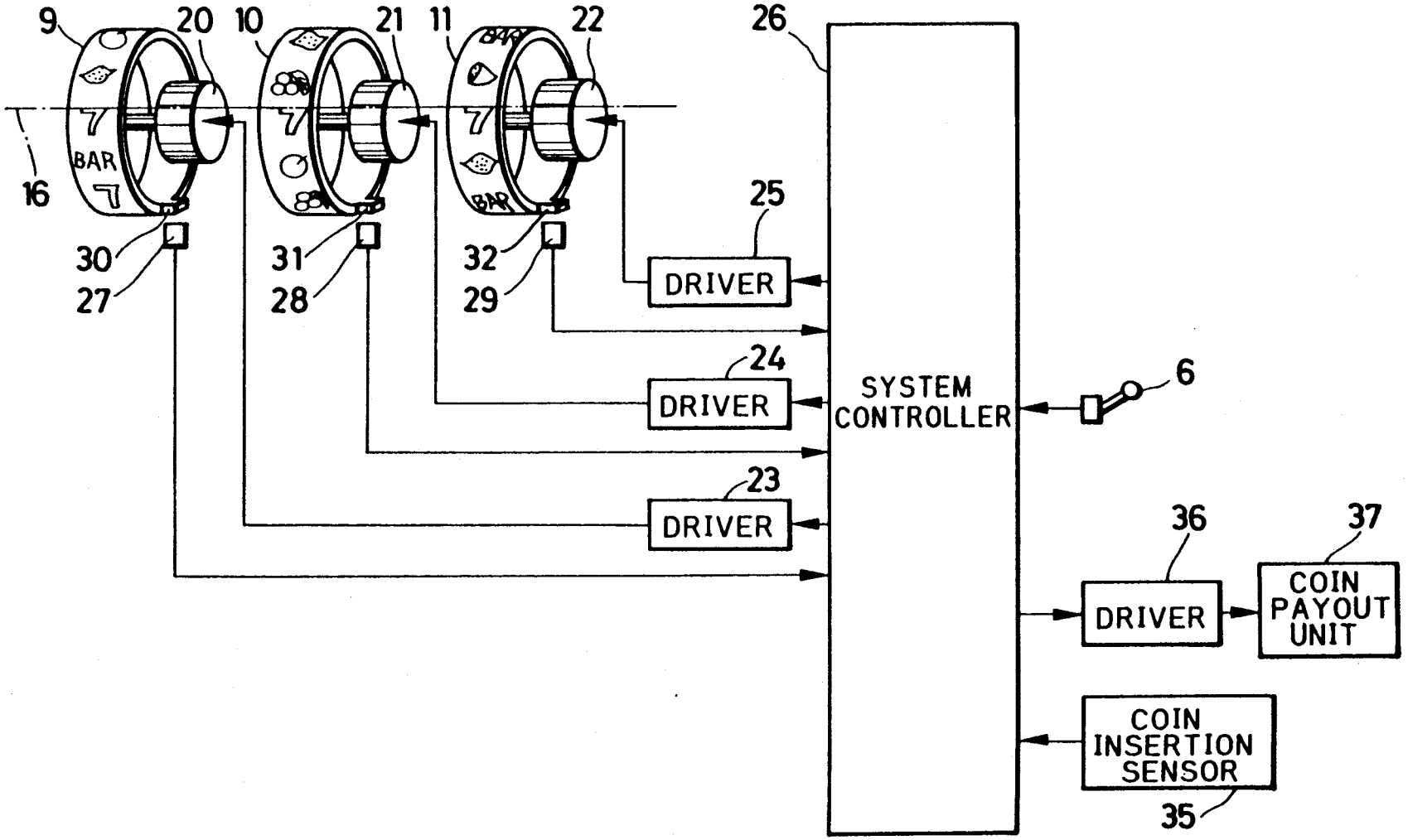
FIG. 2 is a schematic diagram showing the electric circuit arrangement in the slot machine shown in FIG. 1.

Referring to FIG. 2 showing the electric circuits of the slot machine 2, pulse motors 20 to 22 for driving the respective reels 9 to 11 are connected via corresponding drivers 23 to 25 to a system controller 26. Photosensors 27 to 29 connected to the system controller 26 detect light interrupting members 30 to 32 mounted on the reels 9 to 11, and supply signals representative of the reference positions of the reels 9 to 11 to the system controller 26. Connected to the system controller 26 are a start switch 6*a* to be operated by the start lever 6, a coin insertion sensor 35 for detecting a coin inserted into the coin inlet 7, and a coin payout unit 37 which is driven by a driver 36. The start switch 6a outputs a start signal when the start lever 6 is manipulated. The coin insertion sensor 35 outputs a random number generation signal when a coin is detected by the coin insertion sensor 35.

Figure 3:
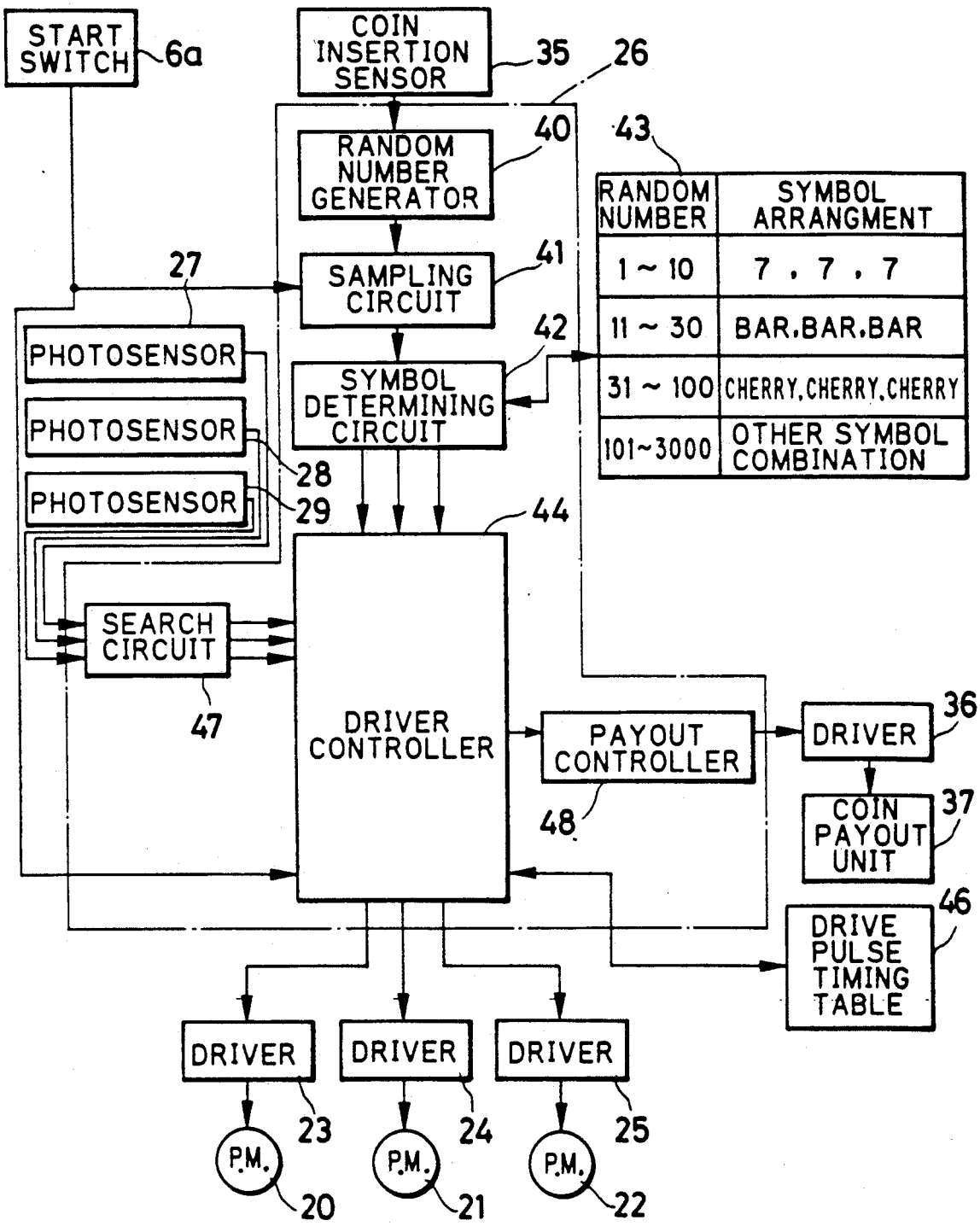
FIG. 3 is a functional block diagram of the system controller shown in FIG. 2.

Referring to FIG. 3 illustrating the function of the system controller 26, a random number generator 40 connected to the coin insertion sensor 35 is actuated by a random number generation signal and generates a random number from "1" to "3000". The random number generator 40 is connected to a sampling circuit 41 which starts sampling upon reception of the start signal. The sampling circuit 41 is preferably constructed such that it does not sample the same random number again in 3000 games.

The sampling circuit 41 is connected to a symbol determining circuit 42 which refers to a symbol table 43, using the sampled number as a key, thereby to determine a symbol combination and the corresponding three symbols thereof. The signals of each determined symbol are sent to a drive controller 44 to which are connected the start switch 6a, a drive pulse timing table 46, a search circuit 47, a payout controller 48, and the drivers 23 to 25 for driving the pulse motors 20 to 22.

The drive controller 44 has an automatic stop function for the stop control of the pulse motors 20 to 22. In this stop control, by referring to the revolution position signals of the reels 9 to 11 supplied from the search circuit 47 to be described later, the drive controller 44 controls the pulse motors 20 to 22 so that the symbols determined by the symbol determining circuit 42 are caused to stop on an effective winning line 16.

The drive pulse timing table 46 stores the frequency data of drive pulses to be sent from the drive controller 44 to the pulse motors 20 to 22. As the pulse frequency becomes higher, the motor revolution rate of the pulse motors 20 to 22 becomes higher, but when a pulse frequency becomes lower, the pulse motor revolution rate becomes lower.

Figure 4:
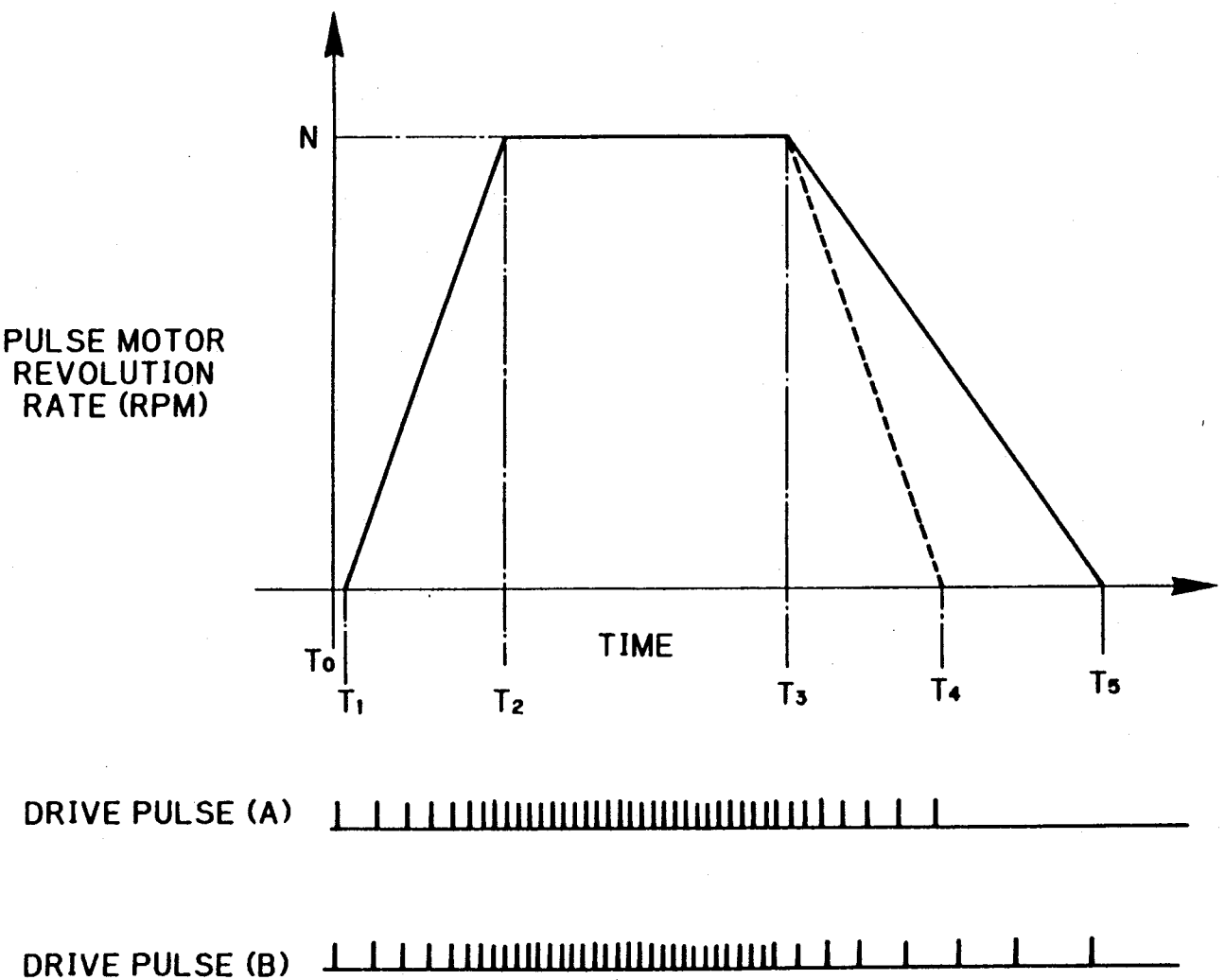
FIG. 4 is a timing chart showing the relationships between drive pulses and pulse motor revolution rates.

When the symbol determining circuit 42 determines a symbol other than the symbol "7", the drive controller 44 sends drive pulses (A) having frequencies as shown in FIG. 4 to the pulse motors 20 to 22 from time $T_3$ thereby to decrease the pulse motor speed, and stops the pulse motors 20 to 22 at time $T_4$. When the symbol determining circuit 42 determines the symbol "7", the drive controller 44 sends drive pulses (B) the same in number as pulses (A) but having lower frequencies to the pulse motors 20 to 22 thereby slowly to decrease the pulse motor speed, and stops the pulse motors 20 to 22 at time $T_5$.

The search circuit 47 checks the positions of symbols on the rotating reels 9 to 11 in accordance with the numbers of drive pulses counted from the time when the photosensors 27 to 29 detect the reference positions. The obtained revolution position signals are sent to the drive controller 44. When it is found that the symbol combination is a hit, then after all the pulse motors 20 to 22 have stopped, the payout controller 48 causes the driver 36 and coin payout unit 37 to pay out coins corresponding in number to the rank of the hit.

Next, the operation of this embodiment will be described with reference to FIG. 4. When a coin is inserted into the coin inlet 7 at time $T_0$ shown in FIG. 4, the coin insertion sensor 35 sends a random number generation signal to the random number generator 40 which then generates random numbers. When the start lever 6 is manipulated at time $T_1$, the start signal is sent to the sampling circuit 41 and drive controller 44.

The sampling circuit 41 samples a random number from the random number generator 40 and sends it to the symbol determining circuit 42. If the sampled random number falls within the range from "1" to "10", the symbol determining circuit 42 refers to the symbol table 43, and three symbol signals for a symbol combination "777" are sent to the drive controller 44. The drive controller 44 supplies drive pulses (B) to the pulse motors 20 to 22 to cause the speed of revolution of the pulse motors to increase until it reaches a constant speed of revolution of N rpm at time $T_2$.

Thereafter, at time $T_3$ after a predetermined time lapse, the drive controller 44 supplies the stop position signal to the pulse motor 20 to stop the pulse motor at time $T_5$ such that the symbol "7" on the first reel 9 stops on the effective winning line 16. In a similar manner, the pulse motors 21 and 22 are sequentially stopped thereby to establish a hit symbol combination "777" on the effective winning line, e.g., the center effective winning line. Immediately thereafter, coins corresponding in number to the hit symbol combination "777" are paid out by the coin payout unit 27. The pulse motors 20 to 22 may be stopped at the same time.

If the sampling circuit 41 samples at time $T_1$ a random number falling within the range from "11" to "3000", the symbol determining circuit 42 refers to the symbol table 43 to determine a symbol combination, and the corresponding symbol signals are sent to the drive controller 44. The drive controller 44 supplies drive signals (A) to the pulse motors 20 to 22 to rotate them. The pulse motor 20 rotating at a constant speed of revolution is caused to start decelerating at time $T_3$ and to stop at time $T_4$. The required stopping time for the game that can have a hit with a large award is set to be longer, as described above, so that players can recognize the possibility of such a special hit beforehand and will be pleased with their good luck before the reels completely stop, thereby enhancing their interest in the game. For the game without a special hit, the required stop time is short so that the next game can be continued quickly. A hit combination is not established on the effective winning line 16 for games that cannot have a hit, and no coins are then paid out.

In the above-described embodiment, for a game that can have a special hit with a large award, the reels are stopped slowly. But instead of this, the reels may be quickly decelerated to a stop. For a game with a hit having a small award other than "777", the revolution rate of the reels may be changed.

The present invention is applicable to slot machines not only of the automatically stopped type but also of the manually stopped type having stop buttons. Furthermore, in the above embodiment, although a series of symbols is carried on the outer periphery of a reel, it will be understood that this invention is equally applicable to a video-type slot machine with symbol series equally displayed on a display unit. Coins may be paid out each time a hit is made, or the number of coins obtained may be added to a credit counter to display the cumulative result each time a hit occurs. In the latter case, without inserting a coin, the game can be started upon manipulation of the start lever 6 and the contents of the credit counter reduced correspondingly. A coin number designation button may preferably be provided so as to designate the number of coins to be considered to have been inserted.

Although the present invention has been described in detail above with reference to a preferred embodiment, it is to be understood that various changes and modifications within the scope and spirit of the invention will be apparent to people of ordinary skill in this technological field. Thus, the invention should be considered as being limited only by the scope of the appended claims.

What is claimed is:

1. A slot machine having a plurality of series of symbols movable during the play of a game past a viewing window, said window having at least one winning line, comprising:

hit determining means for determining whether said game can result in a hit;

time changing means for changing the time required for said series of symbols to decelerate and stop in accordance with the result determined by said hit determining means, thereby to suggest to a player the possibility that said game can result in a hit; and stop control means for controlling the stopping of each of said series of symbols by said required stop time set by said changing means, when a said hit can occur, said stop control means controlling the stopped position of each of said series of symbols thereby to establish a symbol combination that can be a hit on a said winning line.

2. A slot machine according to claim 1, wherein said series of symbols stop automatically.

3. A slot machine according to claim 1, wherein said changing means sets said required stop time longer for a said game that can be a hit.

4. A slot machine according to claim 3, wherein said hit is a special hit with a large award to a player.

5. A slot machine according to claim 4, wherein each said series of symbols is carried on the outer periphery of a reel which is rotated by a pulse motor.

* * * * *